United States Patent [19]

Borneman

[11] 4,204,472

[45] May 27, 1980

[54] DUPLEXING COPYING SYSTEM

[75] Inventor: Lawrence A. Borneman, Lombard, Ill.

[73] Assignee: A. B. Dick Company, Chicago, Ill.

[21] Appl. No.: 931,522

[22] Filed: Aug. 7, 1978

Related U.S. Application Data

[63] Continuation-in-part of Ser. No. 826,847, Aug. 22, 1977.

[51] Int. Cl.[2] ..... B41F 7/06; B41F 21/04; B41F 21/08

[52] U.S. Cl. ..... 101/426; 101/218; 101/230; 101/234; 101/411; 355/24; 271/69

[58] Field of Search ..... 101/230, 229, 231, 232, 101/233, 234, 218, 409, 410, 426, 411, 246, 217, 450, 142; 271/65, 69, 225, 184, 277, DIG. 9; 355/23, 24

[56] References Cited

U.S. PATENT DOCUMENTS

| | | | |
|---|---|---|---|
| 214,065 | 4/1879 | Tucker | 101/230 X |
| 252,153 | 1/1882 | Stonemetz | 101/230 |
| 272,834 | 2/1883 | Hawkins | 101/230 |
| 272,835 | 2/1883 | Hawkins | 101/230 |
| 666,325 | 1/1901 | North | 101/174 X |
| 936,151 | 10/1909 | North | 271/277 |
| 958,484 | 5/1910 | Evans et al. | 101/137 X |
| 2,412,132 | 12/1946 | Dell | 101/232 |
| 2,625,101 | 1/1953 | Gammetter | 101/230 |
| 2,723,119 | 11/1955 | Engebretson | 101/231 |
| 3,012,500 | 12/1961 | Koch | 101/230 |
| 3,557,391 | 11/1970 | Mowry | 101/230 X |
| 3,581,866 | 6/1971 | Hottendorf | 101/230 X |
| 3,654,861 | 4/1972 | Rudolph et al. | 101/183 |
| 3,672,765 | 6/1972 | Altmann | 355/23 |
| 3,690,253 | 9/1972 | Dreyer | 101/217 |
| 3,742,847 | 7/1973 | Zimmermann et al. | 101/230 |
| 3,769,910 | 11/1973 | Heimicher | 101/177 |
| 3,772,990 | 11/1973 | Weisgerber | 101/230 |
| 3,796,154 | 3/1974 | Weisgerber | 101/232 |

FOREIGN PATENT DOCUMENTS

| | | | |
|---|---|---|---|
| 1368496 | 9/1974 | United Kingdom | 101/217 |
| 1465462 | 2/1977 | United Kingdom | 101/230 |

*Primary Examiner*—J. Reed Fisher

*Attorney, Agent, or Firm*—McDougall, Hersh & Scott

[57] ABSTRACT

A system for duplicating images wherein a copy sheet is delivered to a first gripper of an impression cylinder. A first image is transferred to one side of each sheet, and each sheet is then released by the first gripper and delivered to a reversing means. A second gripper includes means for engaging the trailing edge of each sheet and the sheets are thus re-fed to the impression cylinder by this second gripper, trailing edge first. The re-feeding is in synchronism with the second image whereby this second image is transferred to the opposite side of each sheet. The second gripper is provided with inverting means to accommodate the re-feeding. In addition, separate gripper means are provided on the second gripper for engaging the trailing edge of a succeeding sheet whereby the second gripper simultaneously engages the trailing edge of one sheet and the formerly trailing edge of a previously introduced sheet.

19 Claims, 16 Drawing Figures

168
170
150
154
156
158
140
172
174
176
132
134
152
160
162
164
166
167

DUPLEXING COPYING SYSTEM

This application is a continuation in part of application Ser. No. 826,847 filed on Aug. 22, 1977.

BACKGROUND OF THE INVENTION

1. Field of the Invention

This invention relates to a system for the production of duplicate copies of images. The invention is particularly concerned with duplicators of the type wherein copy sheets are supported on a cylinder and transferred to the sheets.

Highly satisfactory duplicating equipment is available for the production of copies with images formed on one side of the copy sheets. Such equipment can be reliably operated at highly satisfactory production rates.

Since copy sheet material of the type conventionally employed can readily accept images on both sides, it would be highly desirable to provide equipment suitable for transferring images to both sides of a copy sheet. This will provide clear savings in the amount of paper employed, additional savings in the amount of space occupied by the copies produced, savings in production time, and savings in cost of equipment.

2. Description of the Prior Art

Attempts have been made to produce copy sheets imaged on both sides (hereinafter referred to as "duplexing"). The use of separate presses located in tandem has been proposed, and although this represents a workable system, it is more costly due to the duplication of equipment involved. Paper handling considerations have also resulted in lower press speeds.

Perfector presses have also been employed for duplexing. Such presses utilize double master cylinders, blanket cylinders, ink systems, and dampening systems. More highly skilled operators and equipment expense make such presses undesirable.

Other proposals include the use of a large combination master and impression cylinder associated with a half-size blanket cylinder. In such an arrangement, the master cylinder places a first-side image onto the blanket cylinder whereby images are placed upon the sheets from the blanket cylinder and also from the impression section of the larger cylinder which includes a letter press or direct lithoplate. This system involves a lower production rate than other systems described.

Duplexing in copiers is accomplished by printing a desired number of first side sheets, storing the sheets, and then re-feeding them for receipt of a second side image. Reference is also made to Altmann U.S. Pat. No. 3,672,765 which discloses "on line" duplexing in photoconductive equipment.

Stonemetz U.S. Pat. No. 252,153 teaches a system for duplexing copies wherein a sheet is introduced between an impression cylinder and a type cylinder. In this system, the type cylinder carries two forms for transferring separate images, and a "blank" area is defined between the forms. The type cylinder makes one revolution while the smaller impression cylinder makes three revolutions. The copy sheet is printed on one side during a first revolution of the impression cylinder and discharged from the equipment. The impression cylinder makes an additional revolution while the "blank" area of the type cylinder passes, and the copy sheet is then re-fed, trailing edge first, for formation of the other image on the other side of the copy sheet during the third revolution of the impression cylinder.

The means for holding sheets on cylinders utilized in systems of the type described generally comprise edge grippers or clamping devices. The clamping means of these devices are adapted to be opened to receive sheets, and then closed for holding the sheets for a predetermined time. The clamps are then opened to release the sheets for transfer to another cylinder or for discharge. British Pat. No. 1,465,462 illustrates a clamping device 7 located on a turning drum. This clamping device is adapted to engage an edge of a sheet whereby the sheet is moved onto the drum. The device is then rotated through 180° whereby the direction of sheet movement can be reversed.

The prior art statement submitted for the above mentioned application Ser. No. 826,847 is incorporated by reference.

SUMMARY OF THE INVENTION

The present invention involves a system for duplexing wherein high production rates can be achieved without excessive expenditures in terms of additional operating mechanisms. For purposes of illustrating the invention, the following description will specifically refer to systems wherein ink images are repeatedly formed on a blanket cylinder or the like. Copy sheets are introduced between the blanket cylinder and an adjacent impression cylinder for transfer of the ink images to the copy sheet. As will be more fully explained, however, applications beyond offset duplicators are contemplated.

The invention is particularly adaptable to the duplexing of copy sheets in offset equipment wherein the master cylinders, blanket cylinders and impression cylinders of the equipment are of conventional size. Moreover, the copy sheets to be duplexed are fed to the equipment at high rates of speed so that duplex copies can be obtained at rates comparable to customary rates of production with high quality offset duplicating equipment.

The system involves the provision of separate ink images on a blanket cylinder. In accordance with this practice, a master cylinder having inking means associated therewith is employed. The blanket cylinder then picks up the ink images from the master cylinder. Drive means rotate these cylinders and an associated impression cylinder in unison while copy sheets are fed between the blanket cylinder and impression cylinder.

First gripper means associated with the impression cylinder are adapted to successively engage the leading edge of each sheet, feed means for the copy sheets introducing one sheet for each revolution of the impression cylinder. The feeding of each sheet is synchronized with the first image on the blanket cylinder so that one side of each sheet receives the first image. Means are then provided for release of each sheet from the first gripper means, and for movement of each sheet to a sheet reversing area.

A second gripper means is adapted to grip the formerly trailing edge of each sheet as each sheet is retrieved from the reversing area. This operation takes place once during each revolution of the impression cylinder. Accordingly, the respective gripping means of the impression cylinder operate to accept separate sheets during each cylinder revolution. The second gripper, by gripping the formerly trailing edge of each sheet, and by moving in synchronism with the second image on the blanket cylinder, provides for transfer of that second image to the opposite side of each sheet.

Stripper means operate in conjunction with the impression cylinder so that sheets imaged on one side only can be delivered to the reversing area while duplexed sheets are delivered to a receiver area for collection. Each gripper means is designed to release the sheet leading edges after impression so that the stripper can effectively operate to remove the sheets. In this connection, the stripper can be readily employed for removing sheets imaged on one side only where this mode of operation is preferred.

Various standard gripper or edge clamping means may be utilized. This invention also contemplates a double gripper assembly which includes a pair of grippers or clamps on opposite sides of a pivot axis. Each gripper or clamp has a stationary lower anvil member and an independently movable upper clamping finger. One clamp is utilized for holding the trailing edge of a sheet on the cylinder while the clamp on the other side of the axis is utilized for holding the leading edge of the following sheet on the cylinder. After complete (180°) rotation, the lower member becomes the stationary lower anvil even though prior to rotation it served as the upper movable finger.

The pivoting gripper or clamping device referred to may be utilized in conjunction with a first gripper of standard design which is located on the impression cylinder diametrically opposite the pivoting gripper. In a typical operation, a clean copy sheet is introduced to the first gripper, and this first gripper then holds the sheet as the first image is being applied. In the course of the continued movement, one clamping means of the pivoting gripper encounters the trailing edge of this sheet and clamps this trailing edge.

The first gripper releases this first sheet at a reversing station, and the pivoting gripper then proceeds to pivot clockwise through 180° while still holding the trailing edge of this sheet. As the impression cylinder continues to rotate, the pivoting gripper will thus automatically operate to withdraw the sheet from the reversing station thereby returning the sheet, trailing edge first, to the impression cylinder. Accordingly, this pivoting gripper will again carry the sheet between the impression cylinder and blanket cylinder for application of the image to the reverse side of the sheet and the pivoting gripper then releases the sheet to a discharge area. In the meantime, the first gripper will have picked up the next sheet and the operation proceeds so that one perfected sheet is discharged during each revolution of the impression cylinder.

DESCRIPTION OF THE PREFERRED EMBODIMENTS

Figure 1:
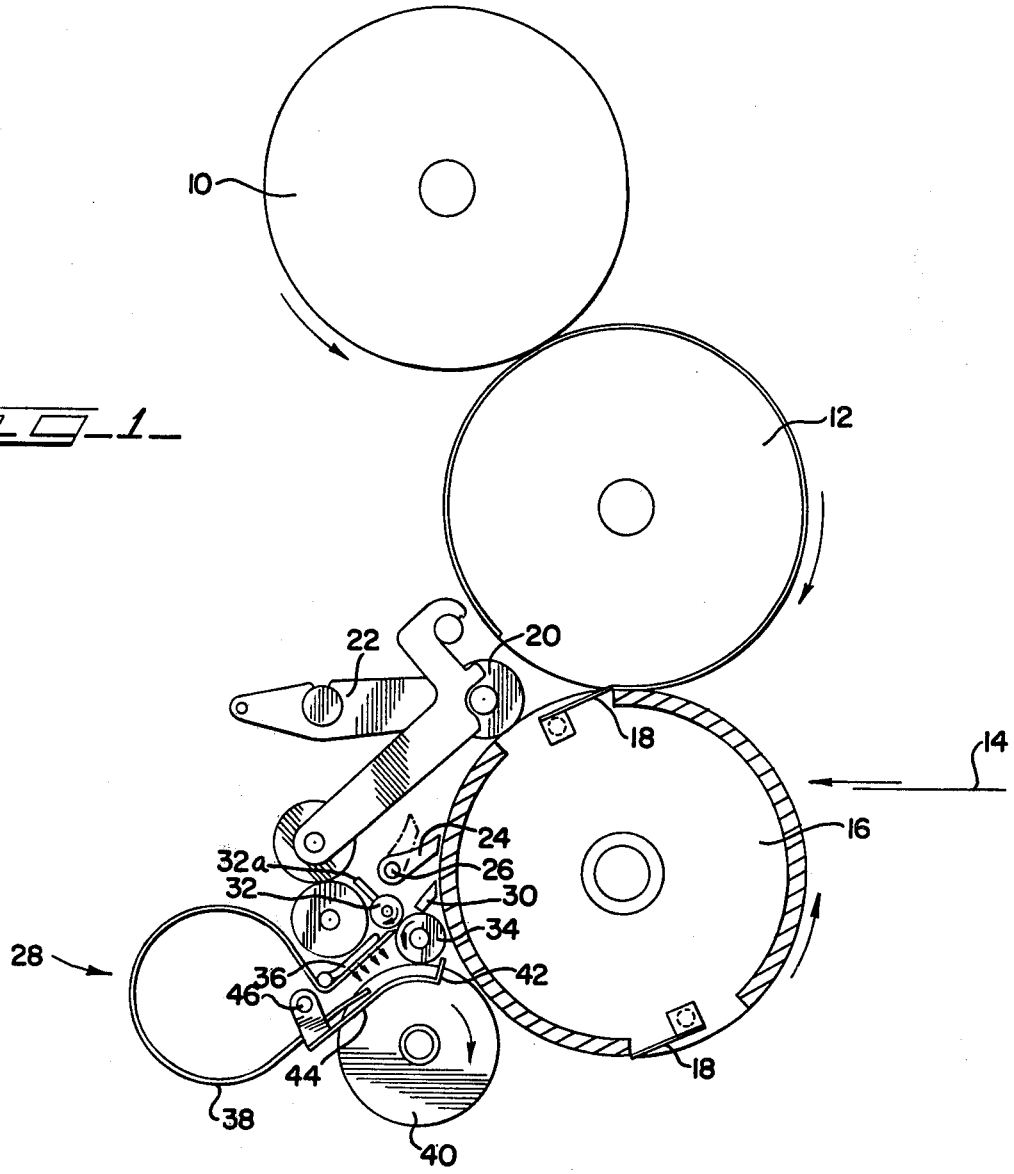
FIG. 1 is a schematic elevational view of offset duplicating equipment characterized by the features of this invention.

FIG. 1 of the drawings illustrates one suitable arrangement for accomplishing the objects of this invention. The structure illustrated comprises an offset duplicating arrangement wherein a master cylinder 10 is employed in association with a blanket cylinder 12. In accordance with this invention, the master cylinder is provided with first and second image plates or sheets or with a single plate or sheet defining first and second image areas. The masters are attached to the master cylinder in conventional fashion, and any suitable ink supply will be utilized in association therewith.

The blanket cylinder 12 is also of conventional design so that ink images will be transferred to the blanket cylinder. It will be apparent that these ink images will be in separate locations on the blanket cylinder.

The features of this invention are adaptable to cylinders of various sizes, depending upon the size of the copies desired. It is to be noted, however, that the invention does not require a variation from standard cylinder sizes in order to produce copies of conventional size. For example, standard size master cylinders will hold separate masters for producing images on $8\frac{1}{2}\times 11$ inch paper with the long axes of the masters being positioned parallel with the cylinder axis. The images on the blanket cylinders can be similarly oriented without difficulty, and $8\frac{1}{2}\times 11$ inch copy sheets are readily fed by conventional means with the side or long edges of the copy sheets comprising the leading and trailing edges during movement through the equipment.

Figure 2:
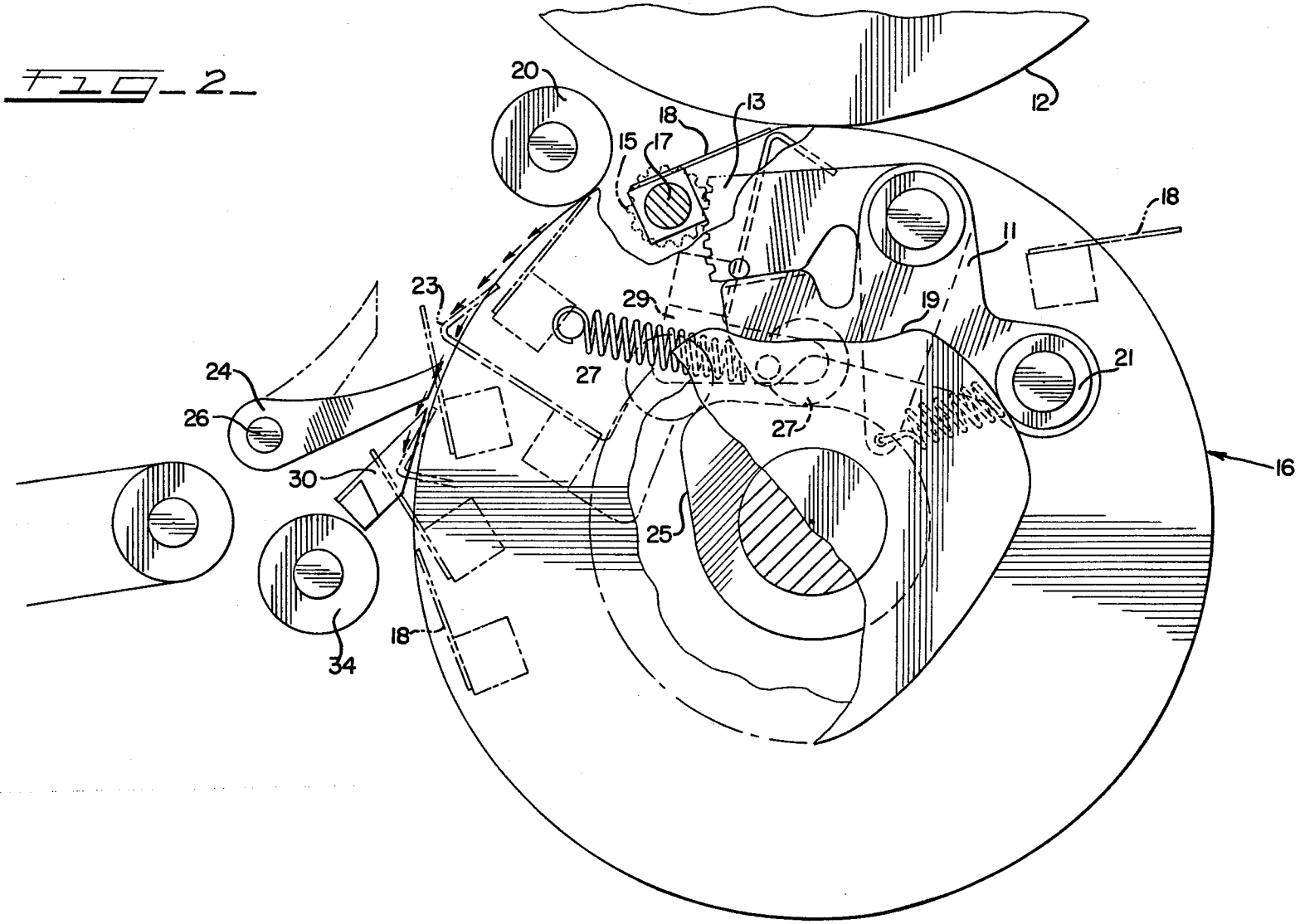
FIG. 2 is an enlarged detail view illustrating the sheet gripping and ejecting functions.

The copy sheets 14 are fed one at a time toward impression cylinder 16. In accordance with conventional practice, the impression cylinder grips the leading edge of the copy sheet, and thereby carries the copy sheet between the impression cylinder and blanket cylinder for transfer of ink images to the copy sheet. Suitable gripping means are available to those in the art, for example, paper grippers of the type employed in A. B. Dick offset duplicators, models 350–360. For purposes of this disclosure, it is sufficient to note that these grippers include pivotally mounted spring fingers 18 adapted to be pressed against copy sheet edges (FIG. 2).

The pivoting movement of the fingers is controlled by fixed cam 19 and follower 21, the latter being mounted on lever assembly 11 having geared end 13. This end engages gear 15 supported on the gripper shaft 17 with rotation of the shaft in response to the cam action causing opening of the fingers for receipt of a paper edge, closing of the fingers for gripping of the edge, and reopening of the fingers for release of the edge. Also in accordance with conventional practice, pushing or ejecting means 23 operate to separate the paper edge from the impression cylinder surface thereby facilitating separation of the paper from the surface. Such ejecting means, as in the above-identified structure, may be operated by a separate fixed cam 25 and follower 27 which act through lever 29.

The structure shown in FIG. 1 includes a pair of grippers having their pivot axes on opposite sides of the impression cylinder 16. Also associated with the impression cylinder is a roller assembly 20 which serves as a rotary chute for the copy sheets as they exit from between the impression cylinder and blanket cylinder. This roller assembly is conventionally provided so that the grippers can commence to open in this area of the operating cycle for commencement of separation of the copy sheets, the roller assembly providing a barrier against premature separation of the paper sheets from the impression cylinder. The roller assembly 20 is pivotally supported by arms 22, and the structure is designed with external rollers in the assembly engaging and riding on a ring surface of the impression cylinder 16 while internal rollers are spaced away from the impression cylinder to thereby define a rotary chute.

Figure 3:
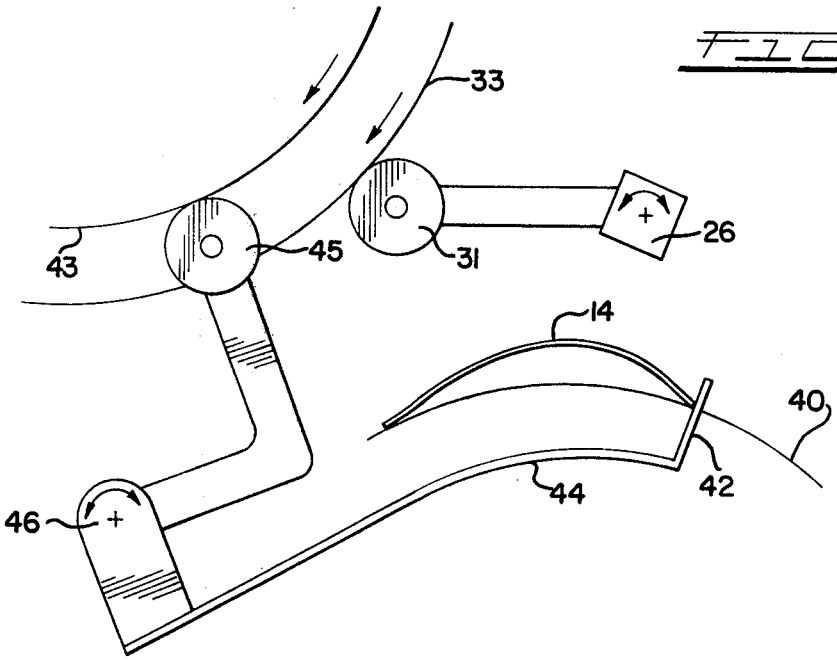
FIG. 3 is an enlarged detail view illustrating certain stripping and sheet stop functions.

A stripper arrangement is conventionally associated with such offset equipment for purposes of directing copy sheets to a receiving tray. In the embodiment illustrated, a plurality of stripper fingers 24 are mounted on shaft 26, and these fingers would be conventionally located in the dotted line position shown. In accordance with this invention, however, the shaft 26 is pivotally supported so that the stripper fingers can be pivoted out of a position where they engage with a copy sheet. This pivoting action is most simply controlled by follower 31 and cam means 33, the latter rotating in unison with the impression cylinder (FIG. 3).

Beyond the stripper fingers 24, this invention provides a copy sheet reversing station 28. This station first includes a fixed stripper blade or fixed stripper fingers 30 whereby all copy sheets passing beyond the pivotable strippers 24 will be fed to the nip of feed rollers 32 and 34. Immediately beyond the feed rollers, there is provided a duct 36 which defines openings whereby air streams are directed against the copy sheet exiting from between rollers 32 and 34. This serves to aid in directing the copy sheet to the interior of cylinder receptacle 38. The size of the receptacle is such that the entire copy sheet will be freely transmitted beyond the rollers 32 and 34. A felt wick **32*a* is provided for carrying etch solution to the surface of roller 32** for moistening the roller so that ink does not offset onto the roller from the freshly printed sheet.

An additional, larger feed roller 40 is provided for operation in association with said roller 34. As the trailing edge of each sheet exits from between the rollers 32 and 34, both the force of the air streams and the engagement of the sheet trailing edge with roller 34 brings the sheet toward the roller 40. As indicated by the illustrated direction of rotation, each sheet is thereby directed to the nip of rollers 34 and 40 for movement back toward the impression cylinder. The formerly trailing edge of each sheet thus becomes the leading edge during this reversing or re-feeding operation.

Stop members 42 are preferably interposed beyond the nip of the rollers 32 and 34 for engagement by the edge of the sheets. These stops are supported on arms 44 which are pivotally supported on a shaft 46. The roller 40 is formed by spaced-apart, disc sections to permit location of the stops within the roller periphery. The shaft 46 is preferably movable by cam means 43 and follower 45 (FIG. 3), so that the stops 42 will be moved out of blocking position relative to each sheet at appropriate intervals. The sheet 14 may be permitted to buckle against the stops 42 to provide positive registration of the sheet edge with the gripper when the stops are retracted.

Figure 4:
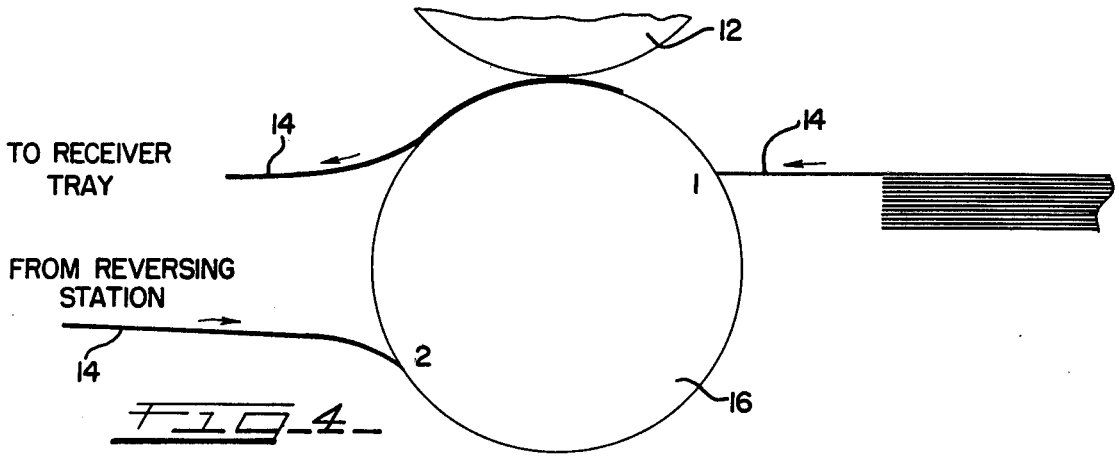
FIG. 4 is a diagrammatic view illustrating a stage of operation of the equipment during duplexing of copy sheets.
Figure 5:
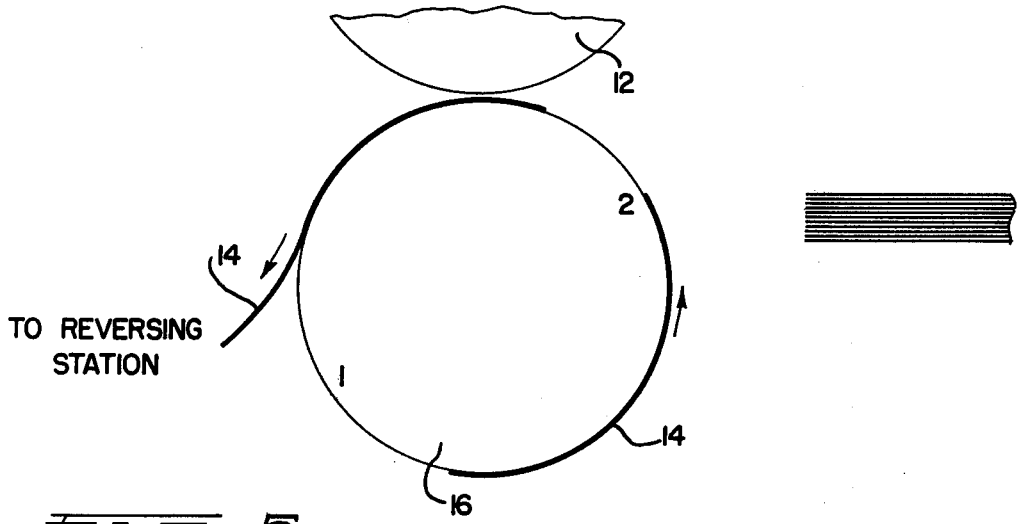
FIG. 5 is a diagrammatic view illustrating a different stage of operation.
Figure 7:
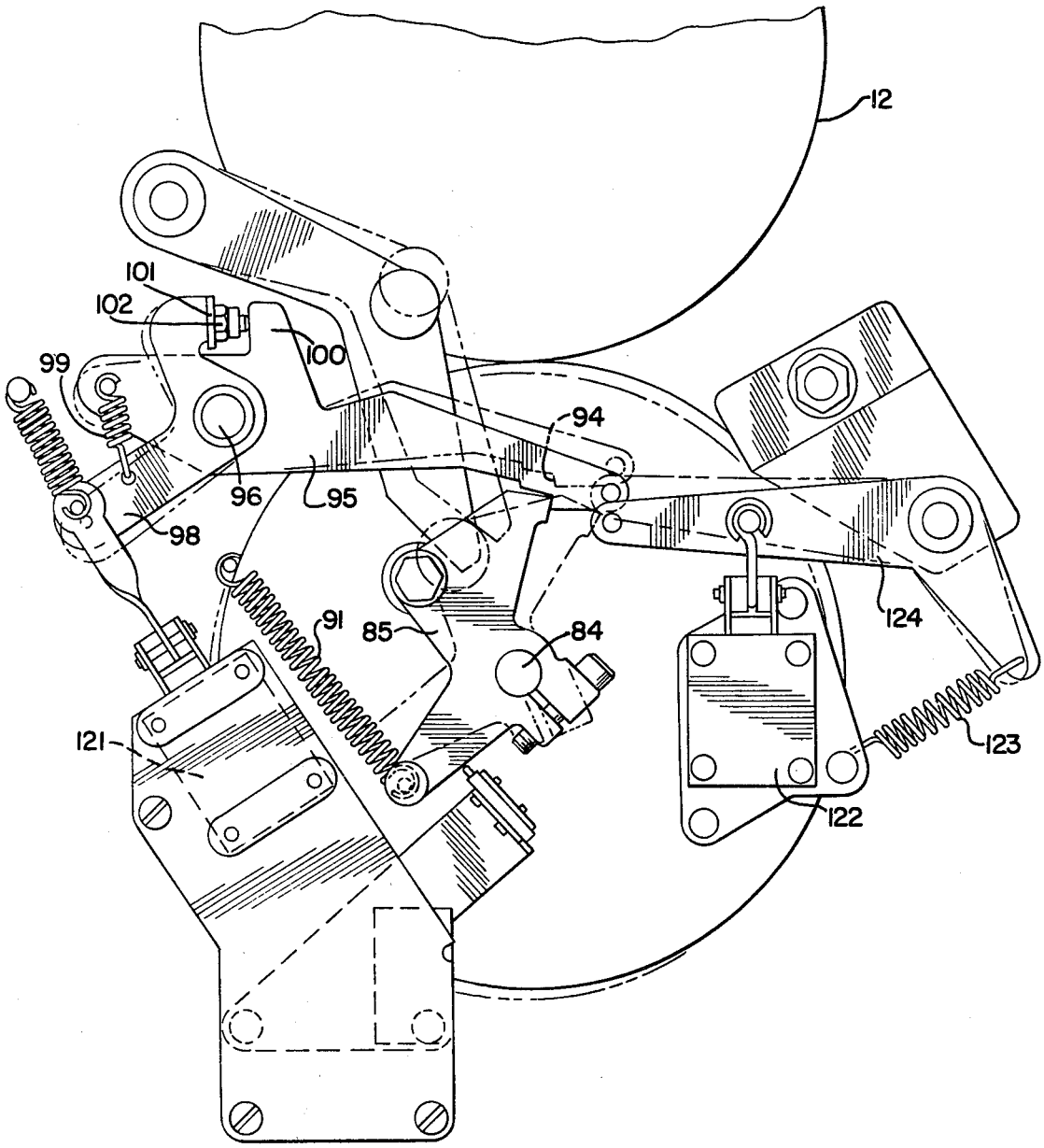
FIG. 7 is an elevational view illustrating cylinder separating mechanisms.
Figure 9A:
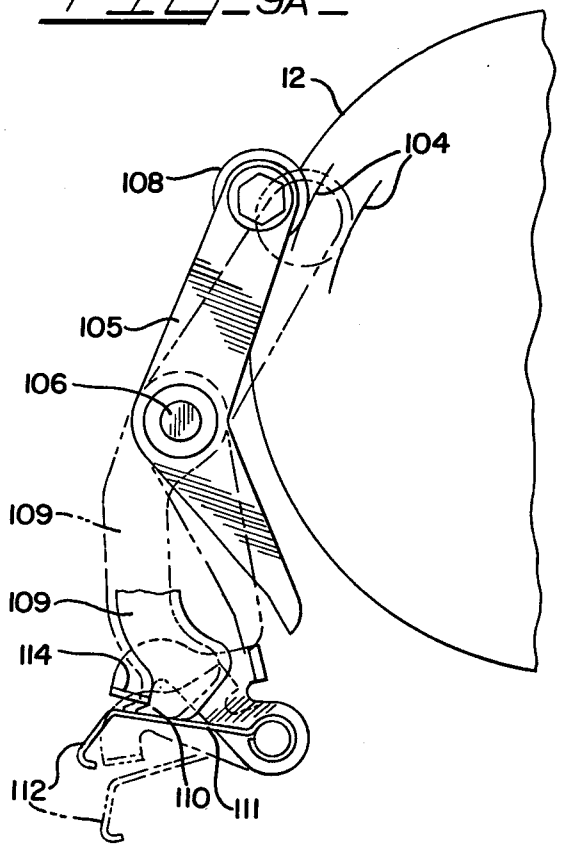
FIG. 9*a* is a fragmentary view, partly cut away, illustrating a paper feeler structure employed for the separating mechanisms.
Figure 8:
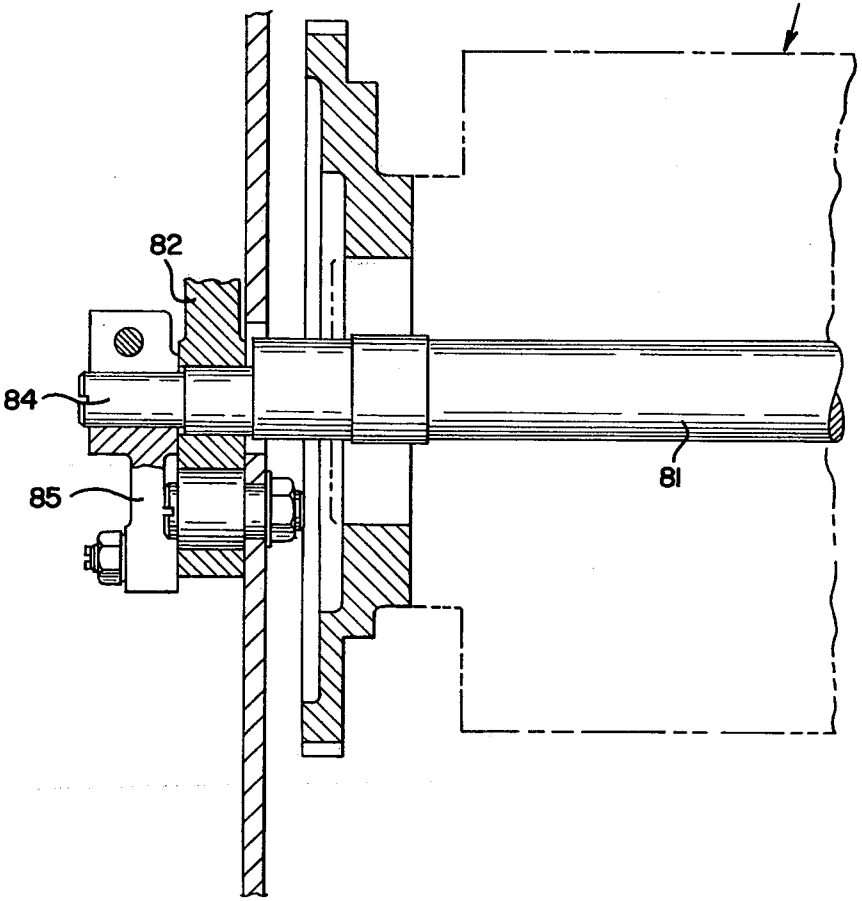
FIG. 8 is a fragmentary, cross-sectional view illustrating the cylinder separating structure in association with the impression cylinder shaft.
Figure 9:
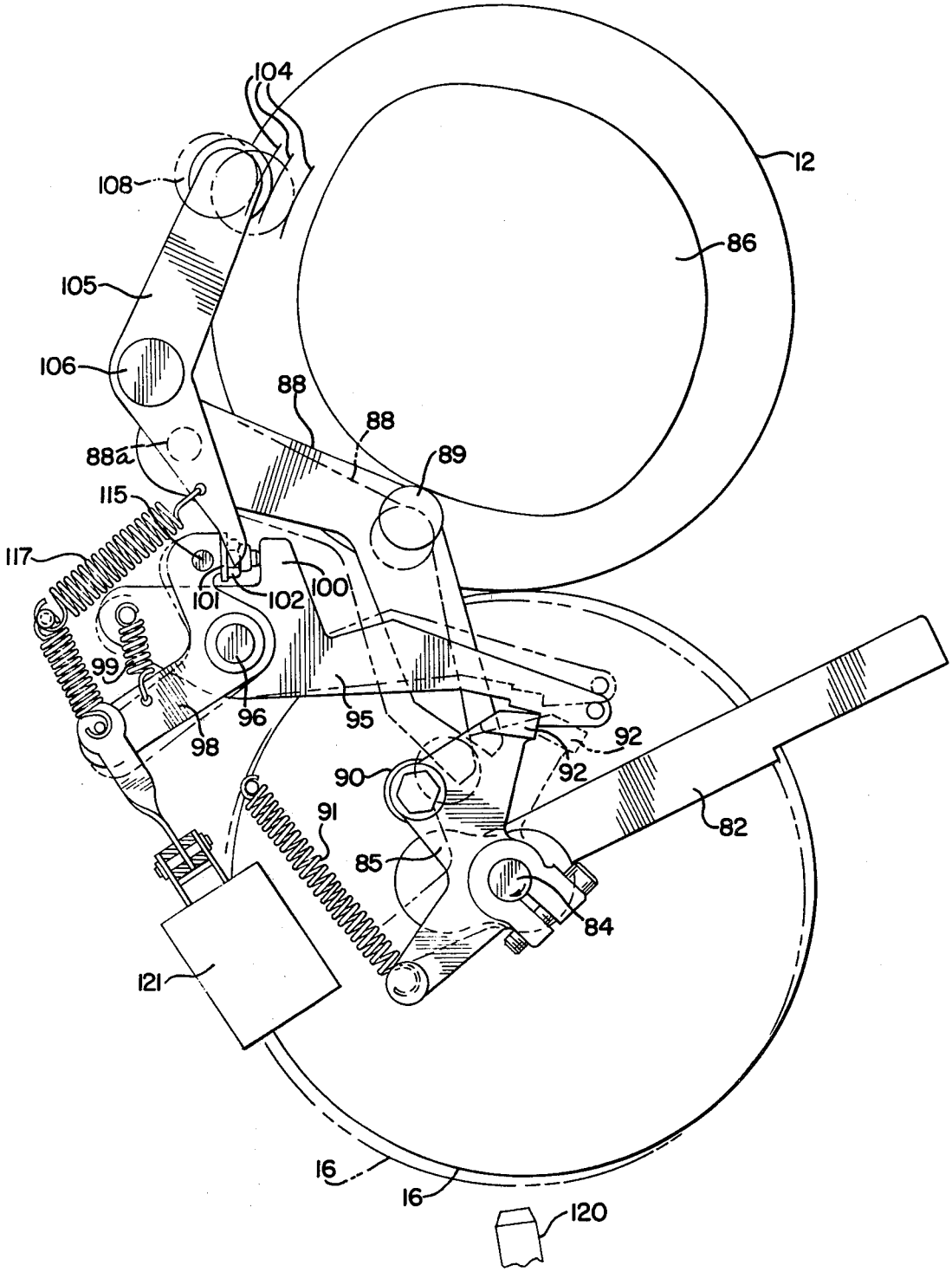
FIG. 9 is an elevational view also illustrating the cylinder separating mechanisms.

FIGS. 4 and 5 illustrate the stages of sheet movement which are accomplished with a construction as shown in FIG. 1. In these figures, the grippers 18 are identified by the numerals 1 and 2. In FIG. 4, the respective grippers are in position for receiving sheets while in FIG. 5, the grippers are shown after 180° of rotation.

A sheet 14 is first fed to gripper #1 as shown in FIG. 4. This sheet is then carried by gripper #1 through the nip of cylinders 12 and 16 for transfer of a first image on one side of the sheet. Thus, the apparatus is synchronized so that the first ink image will be in position for transfer from the blanket cylinder each time gripper #1 brings a copy sheet into position.

As already noted, and as diagrammatically depicted in FIG. 5, gripper #1 releases the copy sheet while the first image is being transferred thereto, and in a duplexing operation, the strippers 24 are then held out of position so that the copy sheet 14 will engage fixed stripper 30 for movement to the reversing station.

After an additional 180° of movement of the impression cylinder, the same sheet 14 has completed the reversing action and the formerly trailing edge of the sheet has been driven into position for engagement by gripper #2 (see FIG. 4). Gripper #1 has, of course, now returned to a position for picking up the next copy sheet so that each gripper will then be carrying a sheet on the impression cylinder. Upon the next 180° of movement, the originally discussed sheet has been brought completely onto or wrapped about the impression cylinder by gripper #2 while the next sheet has received the first image on one side and is being directed into the reversing station (FIG. 5).

FIG. 4 shows the originally discussed sheet after the next 180° of movement, this sheet having been carried through the nip of the cylinders 12 and 16 for transfer of the second image on the opposite side of the sheet. Thus, the cylinder movements are synchronized so that the second image will always be in position for transfer when gripper #2 brings a copy sheet into position. Since gripper #2 only receives sheets from the reversing station, the side of the sheet receiving the second image will always be opposite the side receiving the first image.

As shown in FIG. 4, the sheet released by gripper #2 is directed to a receiver tray, this sheet now having been imaged on both sides. Since gripper #2 picks up a sheet during each revolution of the impression cylinder, it also discharges one sheet per revolution. Accordingly, the equipment produces copy at the rate of one sheet per revolution even though each copy has received images on both sides.

It will be noted that the sheets 14 occupy substantially the complete impression cylinder surface, less the portion occupied by the grippers. This is particularly significant when copy sheets of standard 8½ inch width are utilized since two sheets will readily fit on a standard 7-inch diameter cylinder surface when fed sidewise to the cylinder.

Figure 6:
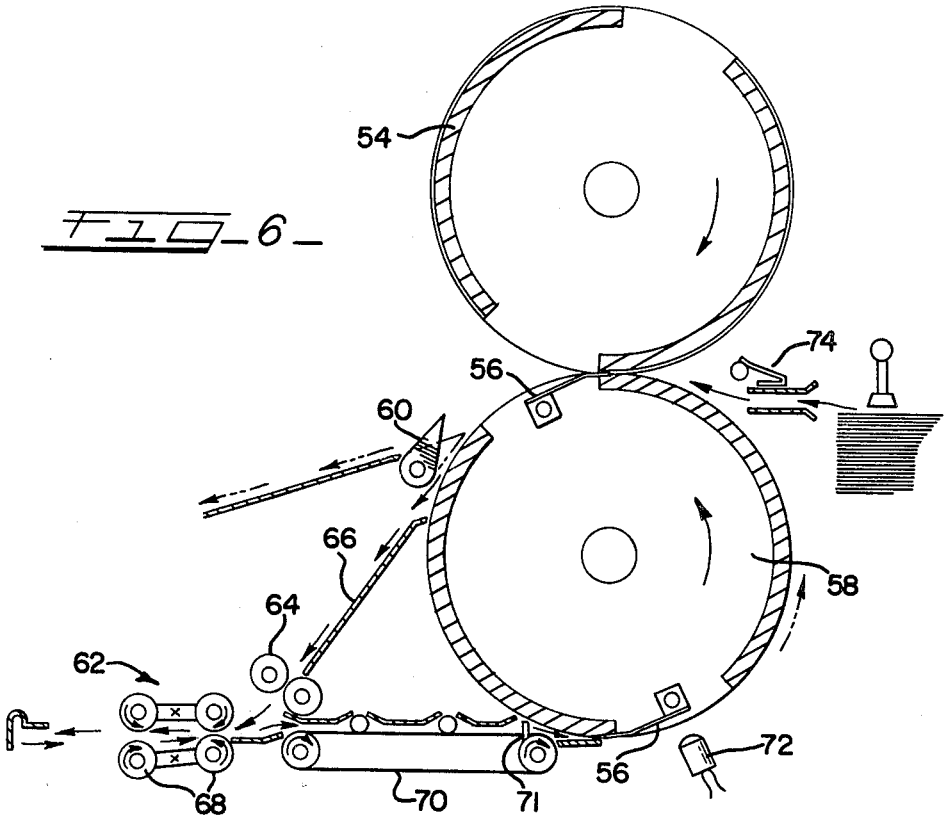
FIG. 6 is a schematic elevational view of an alternative arrangement for a duplexing system characterized by the features of this invention.

The arrangement of the invention shown in FIG. 6 also relates to offset duplicating systems. The blanket cylinder 54 carries first and second images, and a pair of grippers 56 deliver sheets to the nip of the blanket cylinder and impression cylinder 58 in synchronism with the separate images carried by the blanket cylinder. Similarly a pivoting stripper 60 delivers sheets to a receiver tray after duplexing of the sheets while pivoting out of position so that sheets imaged on one side only will be moved to reversing station 62.

The reversing station 62 consists of feed rollers 64 which receive each sheet directed along the fixed stripper ramp 66. Reversing rolls 68 are located in the reversing station so that once a sheet has been released by the drive rollers 64, the sheet may be directed to belt 70 for engagement by the second gripper 56 carried by the impression cylinder. The rollers 68 are of a type mounted on pivoting supports so that the lead pair will serve to draw a sheet into the station and then, after pivoting the lead pair out of contact, and the rear pair into contact, the latter will drive the sheets in the opposite direction.

The rotation of the blanket cylinder is synchronized with the movement of the second gripper means so that the second image on the blanket cylinder will be transferred to the opposite side of a copy sheet once during each revolution. The stripper 60 will then serve to deliver the duplexed copy sheet to a receiver tray.

The arrangement of FIG. 6 includes a paper sensing photocell 72 for purposes of detecting the presence of paper in association with the second gripper. A similar photocell to perform the same function can be incorporated in the embodiment of the present invention depicted in FIGS. 1–5. In the absence of paper, the photocell will signal for movement of the blanket cylinder away from the impression cylinder. In this fashion, the blanket cylinder will avoid contact with the bare surface of the impression cylinder which is highly undesirable in view of the problems encountered when ink is applied directly to an impression cylinder surface.

The mechanisms providing for the retraction of a blanket cylinder away from an impression cylinder are shown in FIGS. 7 through 9*a*. Specifically, these structures comprise standard impression cylinder separating mechanisms with supplemental control means so that the impression cylinder can be moved "off" impression during each half-revolution of operation rather than requiring a full revolution as in the standard operation. More particularly, added paper sensing and cylinder moving mechanisms are provided to insure that a bare impression cylinder surface and the inked blanket surface will not come into contact during either half revolution if no paper is fed from the main feed station or from the reversing station.

Referring to the drawings, the impression cylinder 16 is rotatably journalled on a shaft 81 which is mounted in a main support arm 82, the latter being pivotally connected to the frame of the apparatus. The support arm rotatably receives an offset stubshaft 84 which is integral with and extends from one end of the main shaft 81 so that when a crank lever 85 is rotated clockwise, the shaft 81 and the peripheral surface of the impression cylinder are moved away from the blanket cylinder located above the impression cylinder.

The rotational movement is selectively transmitted to the crank arm 85 by means of cam 86 located at one end of the blanket cylinder 12. The cam is formed with two lobes, each lobe having a profile matched to operations during a respective one of the half revolutions of the impression cylinder. In the exemplary embodiment, an arm 88 is pivotably supported at 88*a* and carries a follower 89 which is spring biased against the cam 86 and responds to the high and low points of the cam. As the cam 86 rotates, the lever 88 is moved between the two positions shown in FIG. 7, one in solid line and the other in broken line, corresponding to the follower riding the cam highs and lows.

The motion of the arm 88 is transmitted to the crank lever 85 through a follower 90 which is mounted on the crank lever 85. The crank lever 85 is spring biased in a clockwise direction by a spring 91 so that there is continually applied to the eccentric stubshaft 84 a turning force tending to separate the impression cylinder from the blanket cylinder to move the impression cylinder "off" impression. However, that turning force applied to the crank lever 85 is normally blocked by a dog 92 integrally formed in the crank arm 85 and locked in a cutout 94 of a lever 95. The cutout is fabricated with an acute angle (by one or two degrees) so the dog 92 engages with a locking action and the lever 95 cannot release until the dog 92 is retracted. Lever 95 is supported at a pivot point 96 and is coupled to a bell crank 98 by a spring 99. The bell crank 98 is also pivotable at 96.

The lever 95 and bell crank 98 comprise what is known as a "split-lever", that is, the two members 95 and 98 will work in unison. However, it is possible to move one of the levers, in this instance the bell crank 98, without moving the other lever and thereby apply a spring loading or urging force to the other lever, in this instance lever 95. The spring 99 applies a counterclockwise force to the lever 95 and a clockwise force to the bell crank 98 so that an ear 100 on lever 95 is urged toward a complementary ear 101 on bell crank 98. The respective ears 100, 101 are separated a preset distance apart by an adjustable lock nut assembly 102.

A paper feeler cam 104 comprises part of the blanket cylinder mechanism. This cam is provided with one lobe related to the timing of paper transport or entry into the impression cylinder. It determines if paper is actually entering and uses that information to select the impression cylinder status, i.e., "on" or "off" impression. If the machine has been in operation and the cylinder has been "on" impression, the blanket cylinder and impression cylinder would be separated if it is sensed that no additional sheets are entering the machine.

The paper sensing subassembly includes a lever 105 mounted on a shaft 106 and having a follower 108 which rides on the cam surface 104. The shaft 106 extends across the width of the machine and has at its other end a depending feeler arm 106. The latter has at its lower extremity a foot 110 which is adapted to catch a paper sensing feeler arm 111. The latter is operative to stop the movement of the arm 109 and therewith the connected members including the arm 105 so that the follower 108 is prevented from riding over the full excursion of the cam, specifically down to the cam low point. The arm 111 engages the foot 110 and prevents the follower 108 from riding into the low of the cam lobe when entry of a sheet of paper is sensed.

The paper sensor arm 111 includes a depending feeler finger 112 that is cyclically operated, for example by a cam (not shown) so as to test for paper. The finger 112 is free to drop through the paper path when no paper is present. The consequence is that the arm 111 pivots so that an integral catch 114 can no longer engage the foot 110 of lever 109. As a result of the "no paper present" signal, the arm 109 is free to swing in a clockwise direction. Accordingly, the follower 108 rides down into the low of cam lobe 104. Clockwise spring force is then applied by spring 117 to the lever 105 to apply a force against a pin 115 on the bell crank 98 thereby transmitting counterclockwise motion to the bell crank 98. As will be appreciated from the description of the split lever operation of lever 95 and bell crank 98, that movement of bell crank 98 stretches spring 99 and applies a counterclockwise urging force to the lever 95.

As described above, the lever 95 includes the cutout 94 which has a locking angle engagement with dog 92 in order to prevent the arm 95 from lifting or rotating counterclockwise when the spring 99 applies the aforedescribed urging force. The lever 95 will not lift until the crank arm 85 and dog 92 are backed away from the notch or cutout 94.

The crank arm 85 is backed away from the notch 94 twice during each cycle of the impression cylinder, which cycling of the crank arm is controlled by the profile of the two lobe cam 86 and the operation of the follower arm 88 as described above. Thus, if a spring urging force is acting on the arm 95 because paper is no longer being fed into the machine, the lever 95 will swing up and permit the crank arm dog 92 to release or swing by and the crank arm 85 to rotate in a clockwise direction. That rotation occurs because the follower 90 moves in response to arm 88 pivoting in a counterclockwise direction as its follower 89 traces the profile of the cam 86. The clockwise movement of the crank arm 85 applies a turning force to the stubshaft 84. Since the main impression cylinder shaft 81 is eccentrically supported relative to stubshaft 84 as already described, the rotary motion of the latter is transmitted as downward movement of the impression cylinder away from the blanket cylinder.

In accordance with the present invention, an additional sensing means, a solenoid assembly, and the additional lobe on the cam 16 are provided to achieve "off" impression when there is no paper feed to either of the gripping means. The additional sensing means comprise a photocell 120 employed to monitor the actual presence of paper on the impression cylinder after it has been fed from the reversing station onto the cylinder. The photocell has a predetermined, cyclic operating period, and if the photocell senses the absence of paper on the impression cylinder during its operative time period, it will activate appropriate electrical circuitry to energize a solenoid 121. Energization of the latter applies a counterclockwise rotation to bell crank 98. The effect of that is to stretch spring 99 and, as has been described above, to apply an urging force to the lever 95 so it will lift when released by the retraction of crank arm dog 92 in response to one of the lobes on cam 86. Crank arm 85 can then rotate in a clockwise direction and move the impression cylinder "off" impression.

The other solenoid 122 is conventionally used to cause cylinder separation when the power is off. Thus, the solenoid is de-energized when power is off and spring 123 then pivots crank arm 124 to release dog 92.

FIGS. 10 through 15 illustrate an alternative form of the invention wherein the impression cylinder 16 is provided with a pivoting gripper 130 to be utilized in association with the diagrammatically opposite gripper 18. The gripper 130 includes oppositely extending clamp fingers comprising the fingers 132 and 134 on one side and the fingers 136 and 138 on the other side.

As is the usual case, a plurality of the grippers 130 are mounted on a shaft 140 in spaced apart relationship whereby sheet edges are sumultaneously engaged at a plurality of spaced apart positions.

In the case of the grippers 130, the shaft 140 has a gear 142 tied to at least one end through a standard one-way clutch, and a driving gear segment 144 engages the gear 142. In the fashion of operation of the previously described segment gear 13, the gear 144 is operatively connected to a cam follower which engages a stationary cam whereby the movement of the gear 144 is controlled in a conventional fashion.

The gears 142 and 144 are provided for rotating the shaft 140 and associated grippers 130 through 180° once during each revolution of the cylinder 16. This is readily accomplished by providing a lobe on a stationary cam surface which will effect a 60° rotation of the gear 144. By providing a gear ratio of 3:1, the gear 142 rotates 180°, and the overrunning clutch associated with the gear 142 then permits re-setting of the segment gear 144 without affecting the grippers 130.

The function of the grippers 130 can be illustrated by reference to FIGS. 10 and 11. In this connection, the gripper 18 is still utilized as the means for gripping the leading edge of an unimaged sheet 14 being fed to the impression cylinder. The movement of the cylinder operates to direct the first sheet between the impression cylinder and blanket cylinder 12 for formation of a first image thereon. The first gripper then releases the leading edge whereby the sheet will be directed by stripper 30 to a reversing means.

As the gripper 18 draws the sheet 14 onto the impression cylinder, the trailing edge 146 of the sheet encounters the gripper fingers 136 and 138 whereby these fingers are adapted to clamp the trailing edge 146. This is illustrated at position I in FIG. 11 and these fingers continue to hold the trailing edge 146 after release by the gripper 18 as illustrated at position II of FIG. 11.

Figure 10:
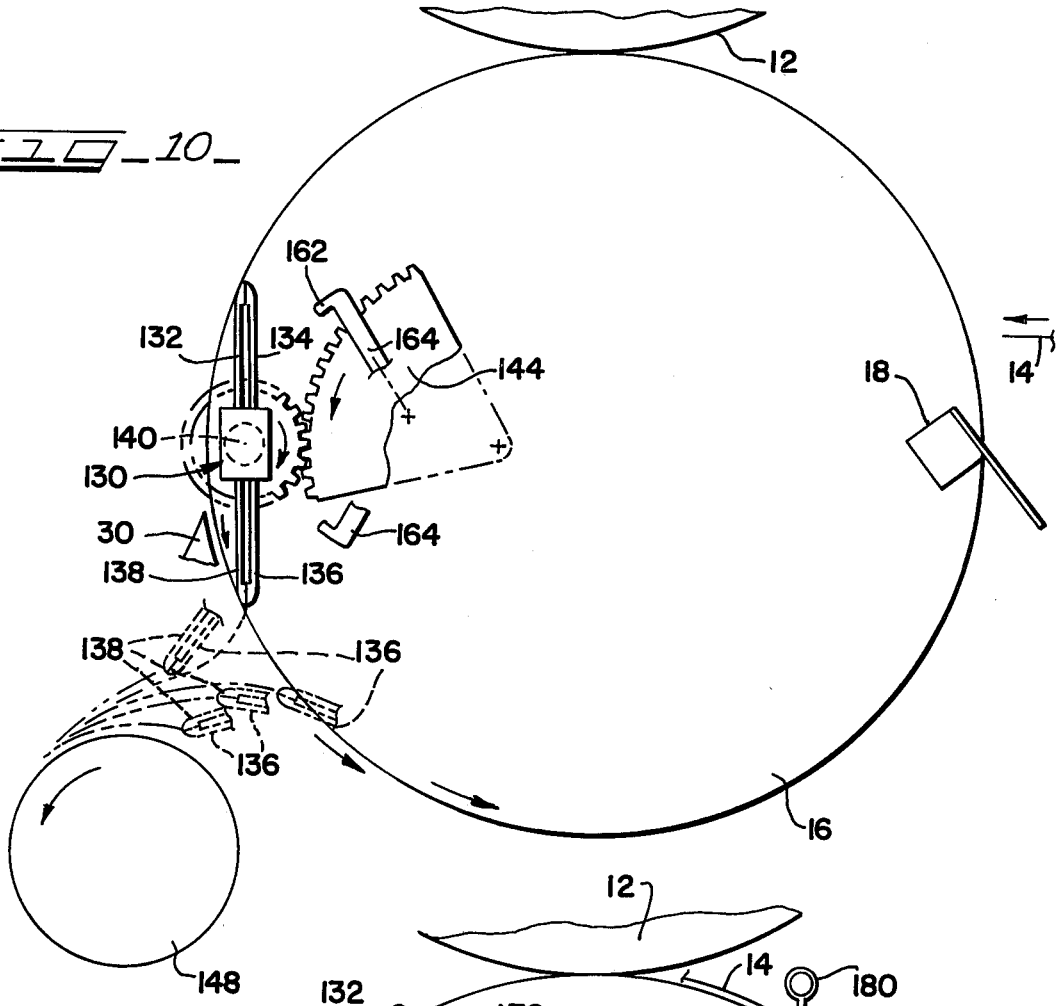
FIG. 10 is a diagrammatic illustration of a pivoting gripper structure including associated drive means and illustrating the sheet reversing sequence.

FIG. 10 illustrates the next phase of the operating sequence. Specifically, the gripper 130 now begins to pivot clockwise whereby the gripper end comprising fingers 138 and 136 will assume the sequence of positions shown. It will be appreciated that the gripper axis continues to move with the impression cylinder and, therefore, the outward movement of the gripper fingers essentially operates to arrest the movement of the trailing edge of the sheet relative to the cylinder. Once the gripper rotation through 180° has been completed, the continued rotation of the impression cylinder pulls the sheet back onto the cylinder; however, the formerly trailing edge now becomes the leading edge of the sheet. The first side image also faces the cylinder surface, and the blank side of the sheet is now exposed for receipt of the opposite side image.

The reversing station may consist of a rotating vacuum cylinder 148. Specifically, this may comprise a perforated cylinder with suction means whereby sheets fed to the cylinder will be maintained on the cylinder. As the reversing action takes place and the gripper fingers begin to draw the sheet back onto the impression cylinder, the sheet will easily move in opposition to the rotation of cylinder 148 since the suction force of that cylinder will be quite small compared to the pulling force of the gripper fingers.

Figure 11:
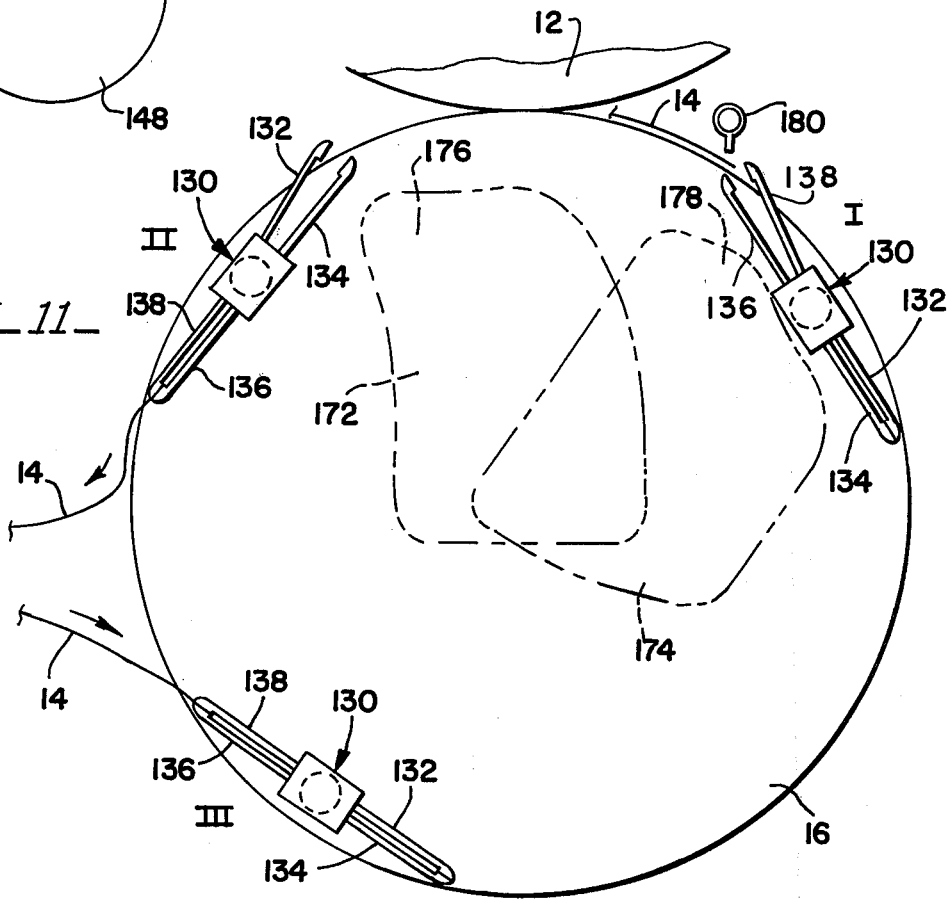
FIG. 11 is a diagrammatic view illustrating an impression cylinder utilizing the pivoting gripper construction with the pivoting gripper shown at different operating positions.

The sheet 14 being withdrawn from the reversing station is shown at position III in FIG. 11. At about this point, the other gripper 18 (FIG. 10) receives the next blank sheet, and this sheet is now directed into engagement with the blanket cylinder for application of the first side image. In the meantime, the other pair of gripper fingers 132, 134 are moved to position I of FIG. 11 for gripping the trailing edge of the second sheet introduced into the system. As the cylinder rotation continues, the first sheet introduced is drawn by the fingers 136, 138 adjacent the blanket cylinder for second side imaging. Immediately thereafter, the fingers 136, 138 open for releasing of the perfected sheet.

Figures 12, 13, 14, 15:
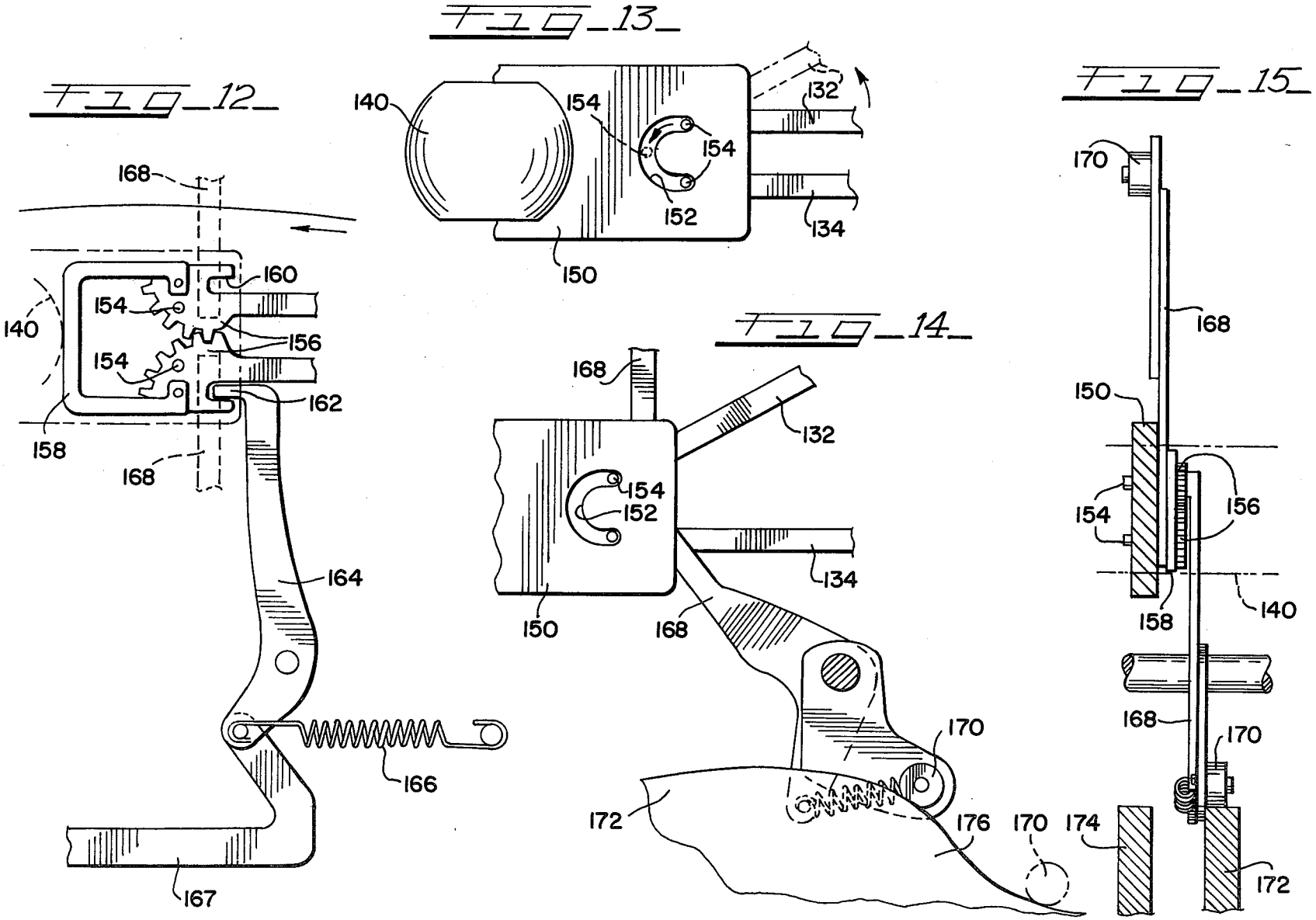
FIG. 12 is a fragmentary view illustrating a suitable pivoting gripper clamp finger latching and connecting means.
FIG. 13 is a fragmentary view illustrating the pivoting clamp fingers and associated support plate.
FIG. 14 is a fragmentary view illustrating the camming operation for pivoting clamping fingers; and, FIG. 15 is an end view of the structure illustrated in FIG. 14.

FIGS. 12 thorugh 15 illustrate an example of a gripper 130 constructed in accordance with this invention. This structure comprises a mounting plate 150 supported on shaft 140 for rotation therewith. The plate defines a pair of arcuate slots 152 on opposite sides of shaft 140, and guide pins 154 are received by these slots. As best shown in FIG. 12, the pins 154 are attached to enlarged end portions 156 formed on each of the gripper fingers. These end portions define mating teeth, and a spring 158 connects the fingers in a pair to hold the teeth in the position of FIG. 12 whereby the gripper fingers are normally closed.

Each of the end portions 156 defines a detent 160 adapted to receive a finger 162 formed on the end of each latch 164. A set of latches is located on each side of the shaft 140 so that the lowermost jaw of each pair will be normally engaged by a latch. Each latch 164 is pivotally mounted on a rod extending between the side walls of the impression cylinder, and a spring 166 normally holds each latch within a detent 160 whereby the latched clamping finger is held against movement relative to plate 150. A drive fixture 167 extends between the pair of latches for each gripper 130, and a cam lobe will operatively engage the fixture once during each revolution to free the grippers 130 for inverting movement.

As best shown in FIGS. 14 and 15, the pins 154 each have an arm 168 attached thereto, and a cam follower 170 is associated with each arm. A pair of cams 172 and 174 are adapted to be engaged by the cam followers.

FIG. 14 illustrates cam 172 having lobe 176 formed thereon. In the normal operation of constructions of the type contemplated by this invention, the cam 172 is stationary with the cam follower moving from right to left in the manner illustrated. It will be appreciated that engagement of the follower with the lobe 176 results in pivoting of the associated arm 168 whereby the upper clamping finger will pivot relative to the lower clamping finger. Specifically, the structure shown in FIG. 14 corresponds with the operation at position two of FIG. 11 where the finger 132 pivots relative to finger 134 to release a perfected sheet for discharge to a receiving tray or the like.

The pivoting action is accomplished since the latch 164 holds the finger 134 against movement. The hinged connection of the portions 156 comprise a Roton continuous hinge of the type produced by Allied Products Corporation whereby one side will "walk over" the other in the fashion illustrated to achieve the pivoting action in opposition to the associated spring 158.

The separate cam surfaces 172 and 174 are provided to achieve the separate opening and closing operations contemplated. In the illustrated example, the cam 172 controls the operation of fingers 132 and 136, whereas, the cam 174 controls the operation of fingers 134 and 138. It is for this reason that the supporting arms 168 are located on opposite sides of the finger portions 156 as illustrated in FIG. 15. The cams 172 and 174 are offset so that these cams will only be engaged by cam followers at appropriate times. More specifically, and as shown in FIG. 11, the cam 172 is designed so that follower 170 disengages after release of a sheet at position two so that the gripper 130 is free to rotate.

The cam 174 defines a lobe 178 at position one, and this lobe is provided for engaging the follower 170 associated with finger 134. Thus, once the fingers 132 and 134 have released a sheet for discharge, they are now free for picking up the trailing end of a newly introduced sheet. Accordingly, the finger 134 will engage the cam 174 to open the finger in opposition to the spring 158 at which time, an air stream may be directed against the trialing end 146 to stuff this trailing end between the open fingers 132 and 134. A manifold 180 is illustrated for this purpose. Once the trailing end is between the fingers, the drop in the cam surface permits closure of the fingers, and these fingers hold the trailing end in the same manner as previously described with reference to fingers 136 and 138.

The cam 172 also controls operation of finger 136 which has its follower 170 positioned for engagement with lobe 176. Similarly, the cam 174 also controls operation of finger 138 which has its follower 170 positioned for engagement with lobe 178. As shown in FIG. 14, the followers on each side of the plate 150 are offset relative to each other so that only one follower in each pair will engage a respective lobe.

As shown in FIG. 10, the latches 164 are adapted to be pivoted out of latching position when the gripper 130 is rotated by operation of segment gear 144. Since the latches are operated just prior to the rotation of the segment gear, the cam follower for the latches may be associated with the cam follower of the segment, for example, a split lever arrangement of the type previously discussed. The first follower function will be to release the latches followed by the segment gear rotation.

The construction illustrated in FIGS. 10 through 15 provides the advantage of eliminating a reversing station capable of feeding a sheet back to a gripper of the impression cylinder. Thus, by providing the pivoting gripper which engages the trailing edge of each fresh sheet, no additional gripping operation is required during the application of the two images. This operation requires only the use of sheets of a predetermined length, and this is more easily provided than a reversing station which will feed a sheet edge to a second gripper in appropriate timed relationship.

It will be apparent that the mechanisms described provide means for duplexing copy sheets without the necessity for substantial changes in equipment size and operating characteristics. With the provision of means for maintaining the pivoting strippers in the operating position, the construction also provides for the formation of copies imaged on one side in the usual fashion. This can be accomplished by a machine operator by means of a simple control so that versatility in the system is achieved in a highly efficient manner.

As previously noted, the construction described is suitable for the production of copies imaged on one side only. This can be readily accomplished by utilizing the standard feed mechanisms for feeding sheets to the impression cylinder in synchronism with images on the blanket cylinder. The stripper mechanism is then maintained in position for removing each sheet after a single pass between these cylinders.

Single side images can also be readily produced by providing a separate conventional feed mechanism for each gripper. Thus, referring to FIG. 4, sheets fed to gripper #2 could be from a stack of blank sheets, and each of these sheets will be imaged by the second ink image on the blanket cylinder. Again, the stripper is simply set to discharge each sheet to the receiver tray.

The first and second ink images on the blanket cylinder may, under these circumstances, be identical images so that each sheet produced will be identical. It will then be appreciated that the construction is capable of producing two copies for each revolution of a cylinder, and significantly improved production rates are obtainable.

As indicated, the invention is applicable to other then offset duplicating systems. For example, the paper handling features could be associated with a cylinder in a xerographic system in place of an impression cylinder, and where a selenium drum would be utilized instead of a blanket cylinder. In such a system, toner particles would be used instead of a wet ink. Furthermore, the invention is applicable to direct lithography systems and to offset systems not having an intermediate blanket cylinder.

In the appended claims, it will be understood that the references to grippers include those other than of the strictly mechanical type, for example, grippers relying on electrostatic attraction or vacuum force to hold sheets on a cylinder. Furthermore, the reference to a cylinder in this description is not limiting since a carrier for the grippers of non-cylindrical cross-section is contemplated.

It will be understood that other changes and modifications may be made in the above described systems which provide the characteristics of this invention without departing from the spirit thereof particularly as defined in the following claims.

That which is claimed is:

1. In a duplicating system wherein images are transferred from image carrying surfaces to copy sheets supported on a carrier, drive means for the carrier, means for feeding the copy sheets to the carrier, gripper means associated with the carrier for gripping the sheets to hold the sheets on the carrier, said gripper means comprising first and second grippers located in spaced relationship on the carrier for holding sheets on the carrier, said first gripper including means for holding the leading edge of each sheet fed to the carrier, and said second gripper including means for holding the trailing edge of each sheet fed to the carrier, the improvement wherein said second gripper comprises two separate sheet holding means independently operable relative to each other, a support mounting the respective holding means of the second gripper in oppositely directed positions, means operating one holding means of the second gripper for gripping the trailing edge of a sheet held by said first gripper, means connected to said support for inverting said second gripper after gripping of the trailing edge by said one holding means of the second gripper, and means operating the other holding means of the second gripper for gripping the trailing edge of the next sheet fed to the carrier.

2. A duplicator in accordance with claim 1, wherein said carrier comprises an impression cylinder, a second cylinder defining said surfaces for carrying said images, said first gripper operating to hold each sheet during movement of the sheets between said cylinders for formation of an image on one side of the sheet, and the respective holding means of said second gripper operating to hold each sheet during movement of the sheets between said cylinders for formation of an image on the other side of each sheet.

3. A duplicator in accordance with claim 1 wherein each said holding means of said second gripper comprise pairs of relatively movable gripping fingers, and including means for selectively opening and closing said fingers for receipt and release of sheet edges.

4. A duplicator in accordance with claim 3 wherein said carrier comprises an impression cylinder, inverting of said second gripper causing said trailing edge gripped thereby to become a formerly trailing edge, and wherein one pair of said fingers holds the formerly trailing edge of one sheet introduced into the duplicator while the other pair of said fingers engages the trailing edge of the next sheet introduced into the duplicator during each revolution of said cylinder.

5. A duplicator in accordance with claim 3 including means for stuffing said trailing edge of a sheet between a pair of open fingers, and means for thereafter closing said fingers for clamping of said trailing edge by the fingers.

6. A duplicator in accordance with claim 5 wherein the stuffing means and means for closing said fingers are located at the position of feeding of each sheet to said cylinder.

7. A duplicator in accordance with claim 3 including support means for each pair of fingers, and a supporting shaft for said support means, a plurality of said support means being located in spaced apart relationship along said shaft whereby sheet edges are engaged at a plurality of positions.

8. A duplicator in accordance with claim 3 including means for maintaining one finger of each holding means stationary, and means for driving the other finger away from the stationary finger during opening of said fingers.

9. A duplicator in accordance with claim 8 wherein the means for maintaining one finger stationary comprises engaging means movable out of contact with said one finger after opening of said fingers and including means for moving said finger engaging means into contact with the other finger after each holding means of said second gripper has been inverted, said driving means then operating to drive said one finger away from the other finger for opening of said fingers.

10. In a duplicating system wherein a carrier is provided for supporting copy sheets, the carrier including gripper means for holding the copy sheets on the carrier and the carrier defining surfaces extending adjacent the gripper means for supporting copy sheets held by the gripper means, the improvement wherein said gripper means include one gripper having two separate sheet holding means independently operable relative to each other, a common support, means mounting each holding means of said one gripper on the common support and locating each holding means of said one gripper in oppositely directed positions, and means for inverting the support to reverse the positions of each said holding means of said one gripper, each of said holding means of said one gripper being adapted to grip an edge of a copy sheet, one holding means of said one gripper being adapted to hold an edge of one copy sheet extending over a carrier surface defined on one side of the common support while the other holding means of said one gripper holds the edge of a separate copy sheet extending over a carrier surface defined on the opposite side of the common support.

11. A duplicator in accordance with claim 10 wherein each said holding means of said one gripper comprise pairs of relatively movable gripping fingers, and including means for selectively opening and closing said fingers for receipt and release of sheet edges.

12. A duplicator in accordance with claim 11 wherein said carrier comprises an impression cylinder, means for feeding sheets to the cylinder, additional gripper means for gripping the leading edge of each sheet fed to the cylinder, and wherein one pair of said fingers holds the formerly trailing edge of one sheet introduced into the system after inverting of said support while the other pair of said fingers simultaneously engages the trailing edge of the next sheet introduced into the system during each revolution of said cylinder.

13. A duplicator in accordance with claim 12 including means for stuffing said trailing edge of a sheet between a pair of open fingers, and means for thereafter closing said fingers for clamping of said trailing edge by the fingers.

14. A duplicator in accordance with claim 13 wherein the stuffing means and means for closing said fingers are located at the position of feeding of each sheet to said cylinder.

15. A duplicator in accordance with claim 11 including a supporting shaft for said common support, and wherein said common support comprises a plurality of supports each having associated fingers, said plurality of supports being located in spaced-apart relationship along said shaft whereby sheet edges are engaged at a plurality of positions.

16. A duplicator in accordance with claim 11 including means for maintaining one finger of each holding means stationary, and means for driving the other finger away from the stationary finger during opening of said fingers.

17. A duplicator in accordance with claim 16 wherein the means for maintaining one finger stationary comprises engaging means movable out of contact with said one finger after opening of said fingers, and including means for moving said finger engaging means into contact with the other finger after the holding means has been inverted, said driving means then operating to drive said one finger away from the other finger for opening of said fingers.

18. In a method for duplicating images on both sides of copy sheets wherein copy sheets are fed in succession between surfaces carrying the images and a carrier for the copy sheets, each sheet being fed to a first gripper on the carrier whereby the leading edge of the sheet is engaged by the first gripper and whereby the sheet is moved between an image carrying surface and the carrier for transfer of a first image to one side of the sheet, the sheet being released by said first gripper, and the trailing edge of said sheet being engaged by a second gripper for movement of the sheet between an image carrying surface and the carrier for duplication of a second image on the opposite side of the sheet, the improvement comprising the steps of providing two separate, individually operating sheet holding means for said second gripper, each said holding means of said second gripper being located in oppositely directed positions, gripping said trailing edge of said sheet with one holding means of said second gripper, releasing the engagement of said first gripper, and inverting said second gripper after transfer of said first image to one side of said sheet whereby the one holding means of said second gripper holds the sheet during transfer of said second image to the other side of said sheet, feeding the next sheet to the first gripper whereby the leading edge of the next sheet is engaged by the first gripper, gripping the trailing edge of said next sheet with the other holding means of said second gripper, and again inverting said second gripper after transfer of said first image to one side of said next sheet whereby the other holding means of said second gripper holds the next sheet during transfer of said second image to the other side of said next sheet.

19. A method in accordance with claim 18 wherein said images are maintained in spaced relationship on a common surface, and including the step of passing each sheet twice between said carrier and said common surface.

* * * * *